United States Patent [19]

Davis

[11] 3,971,098

[45] July 27, 1976

[54] GUTTER CLEANING NOZZLE

[76] Inventor: Donald E. Davis, 2115 Cowper Drive, Raleigh, N.C. 27608

[22] Filed: Feb. 11, 1974

[21] Appl. No.: 441,019

[52] U.S. Cl. ..... 15/410; 15/352; 15/402; 15/415 R; 15/420

[51] Int. Cl.[2] ..... A47L 9/32

[58] Field of Search ..... 15/353, 410, 420, 352, 15/416, 402, 160, 144 A, 144 R, 236 R, 377, 415

[56] References Cited

UNITED STATES PATENTS

| | | | |
|---|---|---|---|
| 838,290 | 12/1906 | Westman | 15/410 X |
| 1,120,980 | 12/1914 | Schofield | 15/402 X |
| 1,661,480 | 3/1928 | Keefer | 15/410 X |
| 2,056,850 | 10/1936 | Goughnour | 15/410 X |
| 2,068,496 | 1/1937 | Linghammar | 15/415 |
| 2,623,234 | 12/1952 | Brown | 15/352 X |
| 2,720,409 | 10/1955 | Griffith | 15/144 B X |
| 2,980,939 | 4/1961 | Sparklin et al. | 15/377 |
| 3,023,971 | 3/1962 | Milhous | 15/236 R X |
| 3,626,542 | 12/1971 | Despain et al. | 15/236 R |
| 3,858,267 | 1/1975 | Swannie | 15/236 R |

*Primary Examiner*—Leonard D. Christian
*Assistant Examiner*—C. K. Moore
*Attorney, Agent, or Firm*—Mills and Coats

[57] ABSTRACT

In abstract, a preferred embodiment of this invention is a device for cleaning gutters without having to use stepladders or other elevating means. This invention is in the form of a novel nozzle used in conjunction with wet/dry vacuum systems.

5 Claims, 9 Drawing Figures

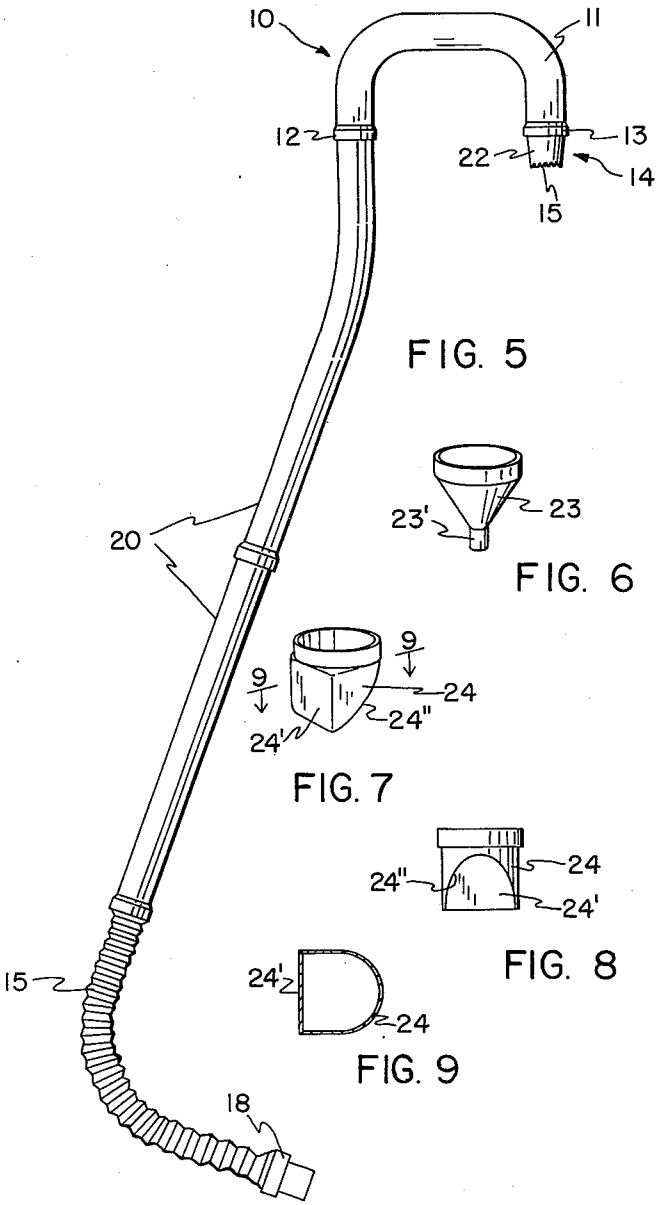
FIG. 5
FIG. 6
FIG. 7
FIG. 8
FIG. 9
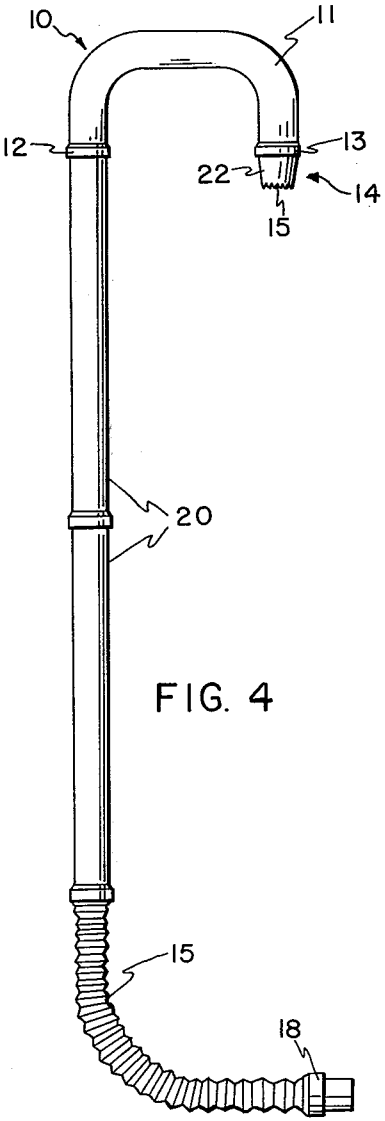
FIG. 4
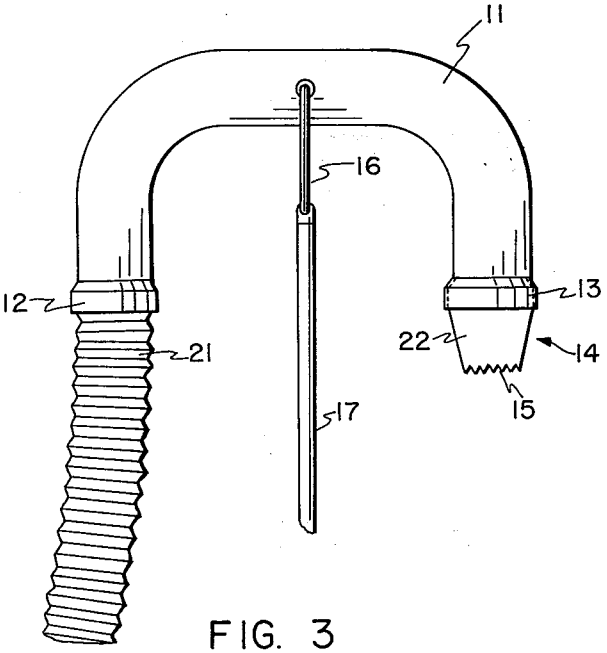
FIG. 3

GUTTER CLEANING NOZZLE

This invention relates to cleaning means and more particularly to wet/dry vacuum system nozzles particularly designed for removing debris from the gutters and roofs of houses.

In the past, the accepted practice of cleaning gutters, downspouts and roof valleys of houses and buildings has been either to manually reach the same through the use of a ladder or for the person doing the work to actually get onto the roof. In either case, there is always an inherent danger involved and thus in many cases the job is left undone or is not accomplished as often as it should be.

Over the years, various attempts have been made to develop devices for the specific purpose of cleaning gutters and downspouts. These devices, however, have generally been cumbersome to use and inefficient in operation with questionable advantageous results.

After much research and study into the above mentioned problems, the present invention has been developed to allow removal of leaves, debris, standing water and the like from gutters, downspouts, and roof valleys while at the same time eliminating excess labor and danger in accomplishing such results.

A standard yard and home wet/dry vacuum is connected to the device of the present invention which through manipulation of the handle connected thereto, allows the cleaning job to be quickly and efficiently accomplished. A plurality of special purpose cleaning heads are disclosed which adapt the invention to varying conditions encountered.

In view of the above, it is an object of the present invention to provide a gutter downspout and roof valley cleaning device for use in conjunction with yard and home wet/dry vacuum systems.

Another object of the present invention is to provide a gutter type cleaning device of such shape and configuration that the same is adapted to quickly and efficiently remove leaves, debris, water and the like therefrom.

Another object of the present invention is to provide a gutter cleaning device in the form of a novel header for use in conjunction with a wet/dry vacuum system.

An even further object of the present invention is to provide a gutter cleaning system, including a means for either sucking or blowing undesirable foreign matter therefrom.

Another object of the present invention is to provide a novel gutter cleaning device which is readily manipulatible into operative position.

Another object of the present invention is to provide a gutter cleaning device which is sectionalized for both operative adjustment and storage.

Other objects and advantages of the present invention will become apparent and obvious from a study of the following description and the accompanying drawings which are merely illustrative of such invention.

IN THE DRAWINGS

FIG. 3 is an enlarged side view of the upper portion of the present invention;

FIG. 4 is a side elevational view of a modification of the present invention;

FIG. 5 is a side elevational view of a second modification of the present invention;

FIG. 6 is a perspective view of the water removal head of the present invention;

FIG. 7 is a perspective view of a head attachment for removing debris from hard to get corner areas.

FIG. 8 is a side elevational view of the attachment of FIG. 7; and

FIG. 9 is a section taken through lines 9—9 of FIG. 7.

Figure 2:
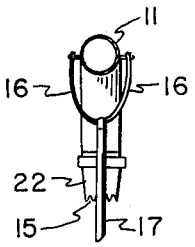
FIG. 2 is a section taken through lines 2—2 of FIG. 1.

With further reference to the drawings, the gutter cleaning nozzle of the present invention indicated generally at 10 is composed of a generally U-shaped manifold 11 terminating at one end with a standard hose connection 12 and at the other end with the nozzle attachment connection 13. Connections 12 and 13 can be of any desired design but preferably are of the snap-on type which is commonly used in conjunction with wet/dry vacuum systems.

A nozzle head indicated generally at 14 is provided which is attached at connection 13 to manifold 11 and is preferably in the form of a slightly tapered frustocone with its smaller tapered end having serrations 15 thereabout.

To the central portion of U-shaped manifold 11 is pivotably secured a yoke member 16. This yoke is fixedly secured to handle 17 which is preferably telescoping so that it can be extended to reach high places and yet is compact for storage purposes. Since the details of telescoping members are well known to those skilled in the art, further description of this feature of the present invention is not deemed necessary.

Secured to connection 12 to the end of manifold 11, opposite nozzle head 14, is a flexible hose 21. This hose can be either of the wire reinforced plastic type or of any other suitable form. Hose 21 is adapted at its end opposite manifold 11 to connect at connection 18 to any one of the large number of commercially available wet/dry vacuum systems. These systems are, of course, available not only for commercial purposes but for yard and home use. As the present state of the art is developed, these are commonly called canister type vacuums because of their shape as indicated in FIG. 1 at 19.

Figure 1:
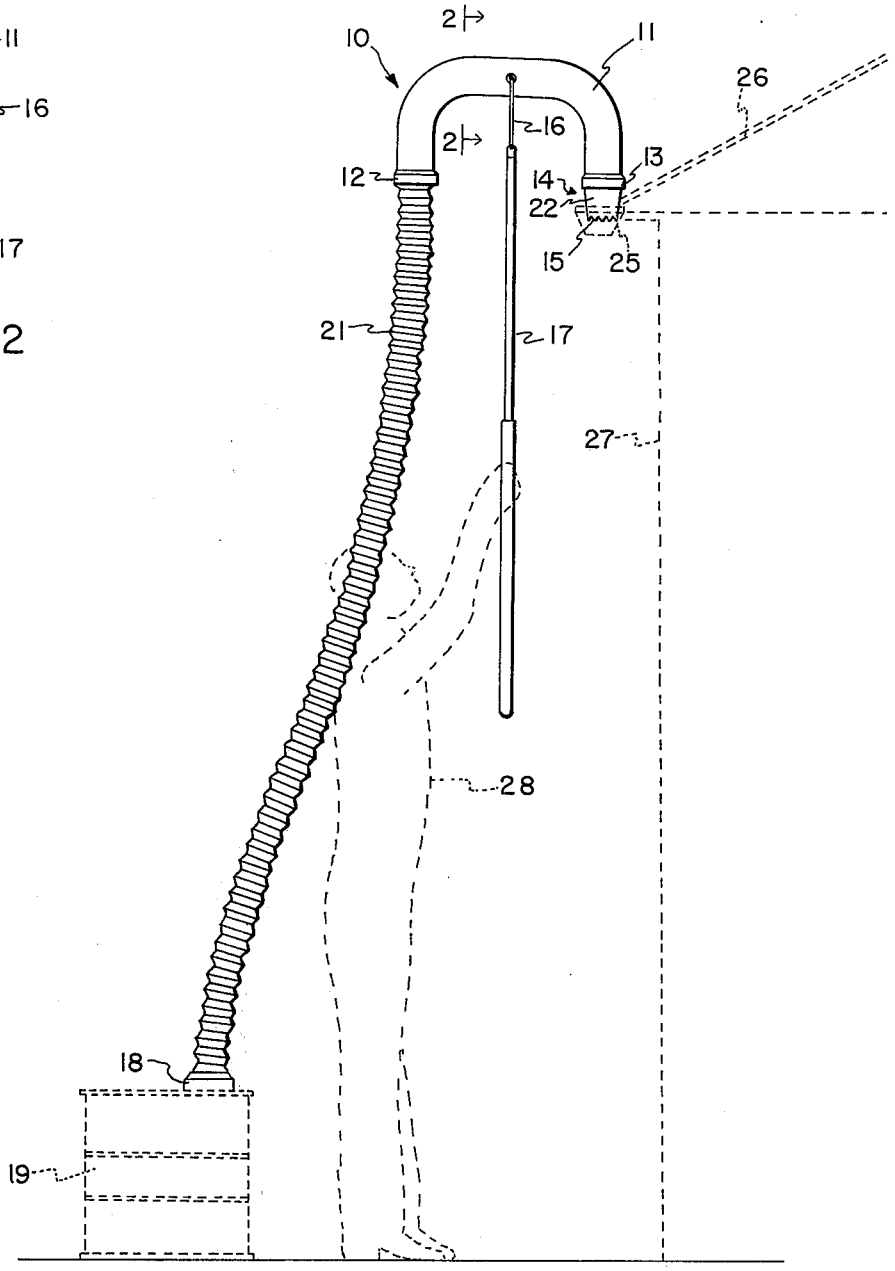
FIG. 1 is a side elevational view of the device of the present invention showing its use in actual operation.

The modification of FIGS. 4 and 5 includes, as in the case of the disclosure of FIG. 1, a flexible hose member 21. This hose in the modification can, of course, be of shorter length than that necessary for the disclosure of FIG. 1 although an extended length of flexible hose would give more versatility to the device of the present invention in that a greater area could be covered prior to having to move the vacuum unit 19.

In addition to the above, it should also be noted that at least one section of the pipe extension 20 of the modification can be bent at an angle as seen clearly in FIG. 5 to facilitate use of the device of the present invention where the operator of the same must stand at some distance away from the area to be cleaned.

In the particular nozzle attachment shown in FIGS. 7 through 9, a flattened portion is provided to be able to get up immediately adjacent areas such as roof valleys, gutter junctions and the like. This attachment is particularly helpful in removing decayed or partially decayed debris.

From an overall view of the present invention, it can clearly be seen that the nozzle attachments take different forms for different purposes. The frustum-shaped attachment 22 with the serrated edge to loosen debris is, of course, one of the primary attachments to be used. The specific water removal nozzle 23 is, of course, a special purpose attachment as is the flattened, special purpose nozzle 24 immediately hereinabove described.

In use of the gutter cleaning nozzle of the present invention, one end of flexible hose 21 is operatively secured to a standard wet/dry vacuum unit and the same is turned on. With a vacuum being pulled on the flexible hose, such vacuum is created through manifold 11 in the nozzle head or attachment indicated generally at 14.

The manifold is then raised either by handle 17 in the disclosure of FIG. 1, or by the pipe extensions 20 of the modification of FIGS. 4 and 5, to a position adjacent the interior of gutter 25 of roof 26 of house 27 or other area to be cleaned. As the cleaning operation progresses, the operator 28 moves the nozzle head 14 along the gutter 25. The vacuum unit 19 can be rolled or otherwise moved along as the cleaning operation progresses.

When an excessive amount of water is encountered in the cleaning operation, it may be deemed necessary or advisable to attach the water nozzle head 23 to the vacuum manifold 11. The restricted end 23' of the attachment creates a greater vacuum to aid in the more efficient removal of water or water soaked debris.

When flat areas such as gutter junction boxes or roof valley areas are encountered, the special nozzle head attachment of FIGS. 7 through 9 is used. Because of its flattened side portion 24' and beveled opening 24'', this modification is particularly useful in such confined areas.

From the above, it is obvious that the present invention has the advantage of providing a highly efficient and yet inexpensive gutter cleaning nozzle system for use in conjunction with wet/dry vacuum systems. This invention also is versatile to allow the cleaning of not only single story roofs but also multi-story roofs and associated valleys and gutters. The invention also has the advantage of allowing all types of debris and foreign matter to be removed because of the plurality of varying shaped nozzle heads.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended Claims are intended to be embraced therein.

What is claimed is:

1. A gutter and roof cleaning nozzle system for use with wet/dry vacuum devices comprising: an integral nozzle manifold; a special purpose nozzle head operatively connected to one end of said manifold whereby debris and other foreign matter can be readily contacted; a continuous, non-telescoping flexible hose means operatively connected at one end to the end of said manifold opposite said nozzle head and at its other end to the wet/dry vacuum source to allow for passage of debris therebetween; and an elongated telescopic handle means supportingly attached to said manifold to allow the height of the nozzle above the ground to be adjusted and the same can be manipulated into operative debris removing position.

2. The system of claim 1 wherein the manifold is generally U-shaped.

3. The system of claim 2 wherein the handle means is connected to the manifold by way of a yoke shaped member.

4. The system of claim 1 wherein the nozzle head is in the shape of a hollow frustum connected at its larger end to said manifold.

5. The system of claim 4 wherein serrated teeth project outwardly from at least a portion of the smaller, outer end of said nozzle head.

* * * * *